US006095109A

United States Patent [19]

Zhou et al.

[11] Patent Number: 6,095,109

[45] Date of Patent: Aug. 1, 2000

[54] METHOD FOR IMPROVED SEALING BETWEEN MEMBERS OF FASTENED JOINT

[75] Inventors: Ming Zhou, Canton; Alan Falkowski, Lake Orion, both of Mich.

[73] Assignee: Chrysler Corporation, Auburn Hills, Mich.

[21] Appl. No.: 09/175,506

[22] Filed: Oct. 20, 1998

[51] Int. Cl.[7] ..... F02F 7/00

[52] U.S. Cl. ..... 123/195 R; 123/195 C

[58] Field of Search ..... 123/195 R, 198 E, 123/195 C; 277/643, 641; 248/672, 675

[56] References Cited

U.S. PATENT DOCUMENTS

| | | | |
|---|---|---|---|
| 292,537 | 1/1884 | Condit | 126/119 |
| 758,888 | 5/1904 | Barrett | 277/614 |
| 2,815,549 | 12/1957 | Olson | 164/37 |
| 3,197,218 | 7/1965 | Coulter | 277/643 |
| 4,681,329 | 7/1987 | Contin | 277/643 |
| 4,817,963 | 4/1989 | Munden et al. | 277/316 |
| 5,433,454 | 7/1995 | Ramberg | 277/643 |

*Primary Examiner*—Marguerite McMahon
*Assistant Examiner*—Jason Benton
*Attorney, Agent, or Firm*—William J. Coughlin

[57] ABSTRACT

In a fastened joint where two or more joint members are secured together, a method for improving the sealing properties of the joint. The method includes the incorporation of one or more depressions into at least one joint surface of the joint members. The depressions are positioned to reduce the tendency of the joint members to transmit clamping forces between non-sealing areas, thereby increasing the magnitude of the clamping forces transmitted through sealing areas and reducing the opportunity for leakage.

12 Claims, 2 Drawing Sheets

METHOD FOR IMPROVED SEALING BETWEEN MEMBERS OF FASTENED JOINT

BACKGROUND OF THE INVENTION

1. Technical Field

The present invention relates generally to fastened joints and more particularly to a method for improving the sealing between the members of a fastened joint by directing the transmission of clamping forces into critical sealing areas.

2. Discussion

Vehicle manufacturers have undertaken substantial efforts over the last decade in an attempt to improve the sealing between members of a fastened joint and eliminate the possibility of a leak between the joint members. Once a persistent leak path has been identified, there is frequently little or no correlation between the amount of resources spent on improving the sealing characteristics of the joint and the amount of expenses incurred through warranty. This is primarily due to the impact of a leak on the consumer's perception of the vehicle. Once a leak has been identified, the consumer will typically attribute a lack of quality to the vehicle generally, rendering it more likely that the consumer will complain to the vehicle dealer and to other consumers. Accordingly, vehicle manufacturers have put a priority on eliminating leaks in an effort to improve the image of their products.

These efforts have primarily focused around the magnitude of residual clamping force which is directed though the sealing area of the joint. One approach has been to maintain the magnitude of residual clamping force above a predetermined minimum level over the entire sealing area. The methods employed under this approach have included improved fastening strategies, increasing the number and/or size of the fasteners, utilizing higher grade fasteners, changing the geometry of the fastener or utilizing specialized gaskets which concentrate clamping force along a desired path. Another approach has been to simply acknowledge that the creation of a leak path is due to an inadequate clamping force exerted over the sealing area and to employ specialized gaskets or sealing compounds (e.g., room temperature vulcanizing silicone or anaerobic sealants) that are more tolerant of such variations in the clamping force. While these methods are often successful, they are attendant with several drawbacks.

One such drawback concerns the impact on those who will either assemble or service the fastened joint. The above mentioned methods, particularly those that employ improved fastening strategies, fasteners of several different sizes or grades or sealing compounds, complicate the assembly or servicing of the joint to some degree. Additional complexity in the assembly or servicing of the joint, especially where the operation is performed on a high volume assembly line, increases the risk that the technician performing the operation will make a mistake, with the results tending to be more catastrophic in nature than a leak. Complicating matters is the fact that often times there is no means available by which one can determine if the assembly/servicing method was performed correctly. For example, a person inspecting the work of the technician after the joint has been fastened cannot reliably determine whether the fasteners have been tightened in the proper sequence or if the proper amount of sealing compound has been utilized.

The primary drawback, however, is the cost associated with each of the above-mentioned methods. These costs are readily discernable where a change is made to the number, size, quantity or geometry of the fasteners; the differential cost is easily calculated from the increased cost of the components added to the additional labor costs, if any. The use of specialized gaskets and sealing compounds can be analyzed in a similar manner. However, restricting the analysis to recurring direct costs prevents the impact of many factors from being considered.

For example, implementation of an improved fastening strategy can require the use of new, more specialized and frequently less efficient fastening tools, especially where torque-turn or yield type fastening strategies are utilized. In addition to the new fastening equipment, new equipment for spot-checking the operation of the fastening process, such as ultrasonic measuring equipment or precision micrometers, may be required. As such, consideration should also be given to cost of purchasing the production and auditing equipment, the recurring maintenance and training costs associated with this equipment and the impact on the efficiency of both direct (i.e., production) and indirect (i.e., auditing) labor.

Consequently, there remains a need in the art for a method for improving the sealing between members of a fastened joint which does not result in a substantial cost and which can be easily implemented without specialized assembly equipment, additional components or materials, or complicated assembly steps.

SUMMARY OF THE INVENTION

It is therefore a general object of the present invention to provide a method which improves the sealing between joint members.

It is a more specific object of the present invention to provide a method for improving the sealing between the members of a fastened joint which does not result in a substantial recurring cost.

It is another object of the present invention to provide a method for improving the sealing between the members of a fastened joint which can be implemented without additional assembly equipment.

It is a further object of the present invention to provide a method for improving the sealing between the members of a fastened joint which does not require additional components, materials or complex assembly steps.

The method of the present invention is operable for obtaining a sealing area having a clamping force which exceeds a predetermined minimum level. The method of the present invention utilizes one or more force distributing depressions placed into the joint surface of one or more of the joint members to direct clamping force out of "non-critical" sealing areas and into "critical" sealing area. The void space of the force distributing depressions prevents clamping force from being transmitted between the joint members in the area of the force distributing depressions. As such, the clamping force that would normally be transferred in these areas is transferred to the sealing area proximate the force distributing depressions, thereby increasing the magnitude of the clamping forces in this area and substantially reducing the opportunity for a leak to propagate through the joint.

Additional advantages and features of the present invention will become apparent from the subsequent description and the appended claims, taken in conjunction with the accompanying drawings.

DETAILED DESCRIPTION OF THE PREFERRED EMBODIMENT

Figure 1:
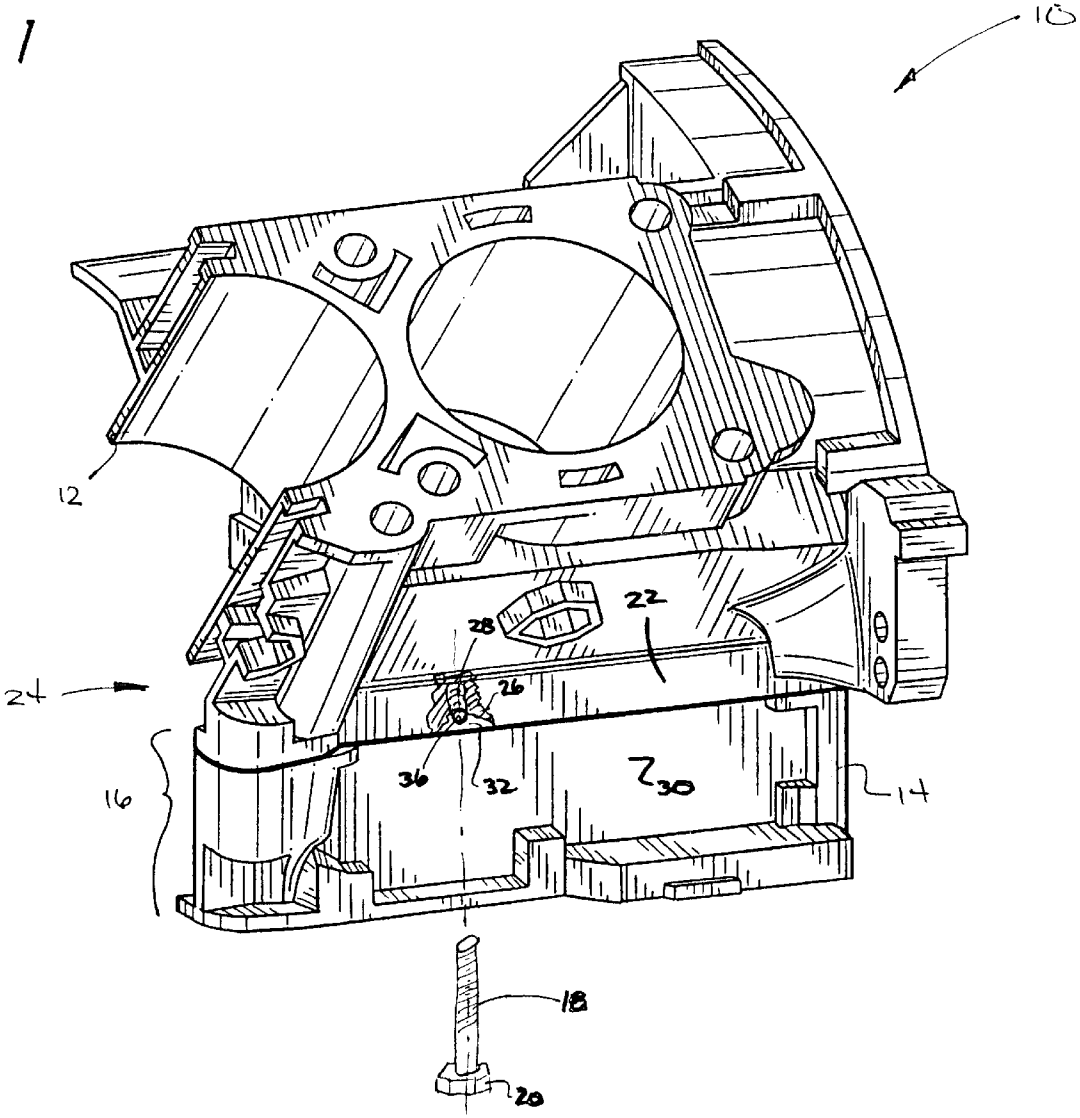
FIG. 1 is a perspective view of a portion of an engine block mounted to an associated portion of a bedplate in accordance with the method of the present invention.

Referring to FIG. 1, an engine assembly 10 is shown to include an engine block 12 and a bedplate 14 which are secured together at joint 16 through a plurality of connectors 18 which are preferably threaded fasteners, such as bolts 20. It should be appreciated that the reference to an engine assembly is merely exemplary and that it is contemplated that the teachings of the present invention are applicable to any fastened joint where the sealing of a leak path between the joint members is desired. As such, the accompanying figures are not intended to limit the scope of the present invention.

Engine block 12 includes a sidewall 22 which serves to confine a first portion of a fluid cavity 24 within engine assembly 10. Sidewall 22 extends the length of engine block 12 and terminates at its lower edge, designated as first joint surface 26. First joint surface 26 has been machined as a substantially horizontal plane having a flatness and a surface finish within generally accepted levels. First joint surface 26 includes a plurality of threaded apertures 28 which have been conventionally machined into engine block 12 and which are sized to threadably engage bolts 20.

Figure 2:
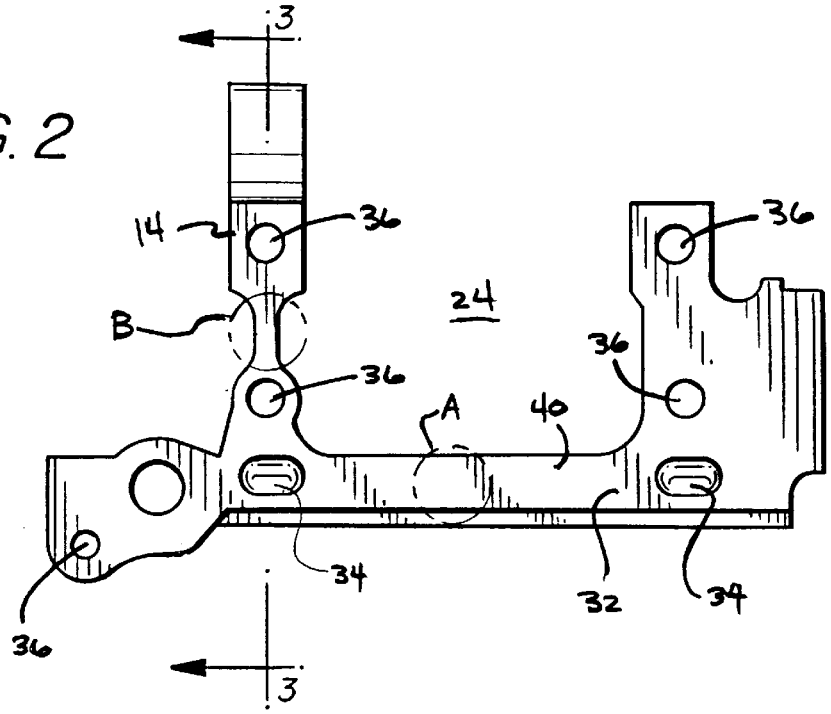
FIG. 2 is a view of the top surface of the bedplate shown in FIG. 1.
Figure 3:
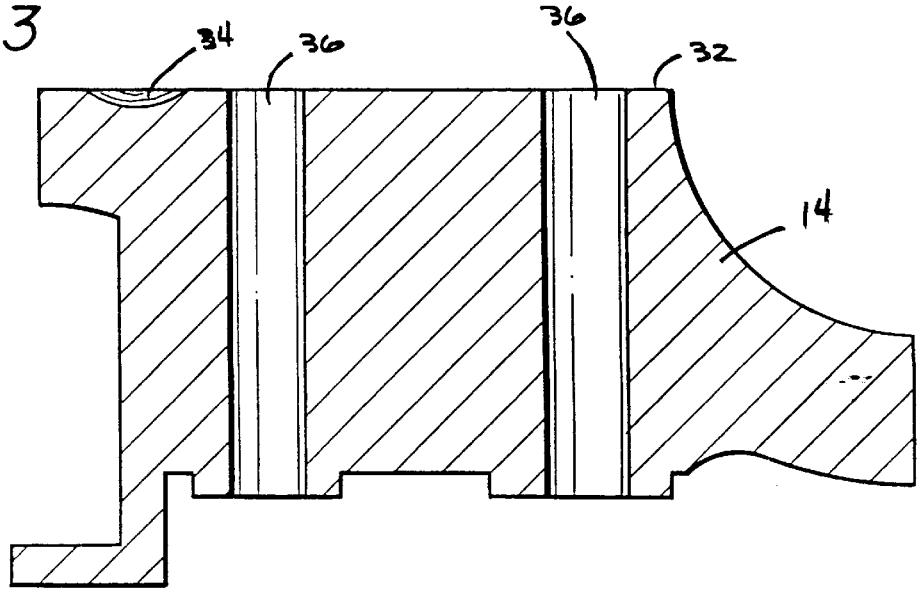
FIG. 3 is a cross-sectional view taken along the line 3—3 of FIG. 2.

Bedplate 14 also includes a sidewall 30 which serves to confine a second portion of fluid cavity 24 within engine assembly 10. Sidewall 30 extends the length of bedplate 14 and terminates at its upper edge at second joint surface 32. Second joint surface 32 has been machined as a substantially horizontal plane having a flatness and a surface finish within generally accepted levels. With additional reference to FIG. 2, second joint surface 32 is shown to include at least one force distributing depression 34 and a plurality of cylindrical apertures 36 which extend through bedplate 14. Cylindrical apertures 36 are sized to receive bolts 20 and are positioned along second joint surface 32 so as to correspond with threaded apertures 28 in first joint surface 26. Second joint surface 32 is otherwise the mirror image of first joint surface 26.

A sealing area 40 is created by bringing engine block 12 in close proximity to bedplate 14, aligning cylindrical apertures 36 to threaded apertures 28, inserting bolts 20 into cylindrical apertures 36 and tightening bolts 20 so as to apply a clamping force to joint 16 causing first and second joint surfaces 26 and 32 to be forced together. Sealing area 40 is comprised of the entire area where first joint surface 26 contacts second joint surface 32. For purposes of this discussion, it will be assumed that sealing area 40 is comprised of the entire second joint surface 32 (i.e., any solid portion of the area correlating to the substantially horizontal surface of bedplate 14). As such, sealing area 40 is comprised of "critical" sealing areas which if eliminated would result in a leak, and "non-critical" sealing areas, which if eliminated would not result in a leak. For example, if the portion of sealing area 40 designated by reference letter A were eliminated, fluid in fluid cavity 24 would pass through joint 16 at this point, causing a leak. This portion of sealing area 40 is therefore critical. Conversely, if the portion of sealing area 40 designated by reference letter B were eliminated, fluid in fluid cavity 24 would not pass through joint 16 and a leak would not be created. This portion of sealing area 40 is therefore non-critical.

Sealing area 40 is operable for transmitting the clamping force created during the tightening of bolts 20. The magnitude of the clamping force is not maintained at a uniform level throughout sealing area 40 but rather varies as a function of the distance from bolts 20. As is known in the art, the magnitude of the clamping force is highest at locations close to bolts 20 and decreases as the distance away from bolts 20 increases. Transmission of clamping force through non-critical sealing areas, especially those in close proximity to bolts 20, causes the amount of clamping force available for critical sealing areas to be diminished and increases the opportunity for a leak to propagate through joint 16. Force distributing depressions 34 are therefore provided to direct at least a portion of the clamping forces out of non-critical areas and increase the level of clamping force transmitted through the surrounding critical sealing areas.

Force distributing depressions 34 are preferably shallow and have a cycloidal cross section to eliminate the possibility of causing a stress fracture. In the example shown, force distributing depressions 34 are approximately 20 mm long by 11 mm wide by 1.5 mm deep. However, the actual size, geometry and position of force distributing depressions 34 will vary according to the specific characteristics of the joint in the application. Optimal sizing and positioning of force distributing depressions 34 for a specific application can be calculated though finite element analysis of the joint or empirically derived through the use of pressure sensitive films or other force measuring equipment.

Once the size and location of force distributing depressions 34 has been determined, they can be incorporated into a joint surface during the fabrication of the joint member. While force distributing depressions 34 can be machined into a joint surface, they are preferably incorporated into the production tooling which is used to cast, mold, stamp, emboss or otherwise form the joint member.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims.

What is claimed is:

1. An engine assembly for a motor vehicle comprising:

an engine block having a first joint surface;

a bedplate having a second joint surface adapted to abut said first joint surface and establish a fastened joint;

at least one force distributing depression formed in one of said first joint surface and said second joint surface, said at least one force distributing depression operative to distribute a clamping force when said engine block and said bedplate are clamped together, said at least one force distributing depression being free of sealant material.

2. The engine assembly for a motor vehicle of claim 1 wherein said at least one force distributing depression has a generally cycloidal cross section.

3. The engine assembly for a motor vehicle of claim 1 wherein said at least one force distributing depression is formed in said bedplate.

4. The engine assembly for a motor vehicle of claim 3 wherein said second joint surface of said bedplate includes a longitudinally extending portion and a laterally extending portion, said at least one force distributing depression formed at an intersection between said longitudinally extending portion and said laterally extending portion.

5. A method for joining an engine block and a bedplate of a motor vehicle engine to form a sealed joint, the method comprising the steps of:

providing first and second connector holes in the engine block and the bedplate, respectively;

providing at least one force distributing depression in one of the engine block and the bedplate to cause the distribution of a clamping force in a predetermined manner, said at least one force distributing depression being free of sealant material;

bringing the engine block and the bedplate together into close contact such that the first and second connector holes are aligned; and engaging the first and second connector holes with a connector to cause a clamping force to be exerted between the engine block and the bedplate, thereby forming the sealed joint therebetween.

6. The method of claim 5, wherein the connector is a threaded fastener and the step of engaging the first and second connector holes includes the step of threadably engaging at least one of the first and second connector holes.

7. The method of claim 5, wherein said step of providing at least one force distributing depression includes the step of casting the one of the engine block and the bedplate to include the at least one force distributing depression.

8. The method of claim 5, wherein said step of providing at least one force distributing depression includes the step of molding the one of the engine block and the bedplate to include the at least one force distributing depression.

9. The method of claim 5, wherein said step of providing at least one force distributing depression includes the step of embossing the one of the engine block and the bedplate to include the at least one force distributing depression.

10. The method of claim 5, wherein said step of providing at least one force distributing depression includes the step of stamping the one of the engine block and the bedplate to include the at least one force distributing depression.

11. The method of claim 5, wherein said step of providing at least one force distributing depression includes the step of machining the one of the engine block and the bedplate to include the at least one force distributing depression.

12. The method of claim 5, wherein said step of providing at least one force distributing depression includes the step of providing a force distributing depression having a cycloidal cross section.

* * * * *